United States Patent [19]

Beese

[11] 4,372,592

[45] Feb. 8, 1983

[54] LOCKING DEVICE

[76] Inventor: Miki E. Beese, R.R. #3, Goderich, Ontario, Canada, N7A 3X9

[21] Appl. No.: 219,982

[22] Filed: Dec. 24, 1980

[51] Int. Cl.[3] ..... E05C 19/18

[52] U.S. Cl. ..... 292/288; 160/234; 403/100

[58] Field of Search ..... 292/288, 145, 147, 150, 292/152, 157, 262, DIG. 57; 403/100, 329, 330; 160/233, 234, 229

[56] References Cited

U.S. PATENT DOCUMENTS 839,297 12/1906 Kennedy et al. ..... 403/329 X 3,428,349 2/1969 Shelton ..... 292/288

4,228,842 10/1980 Clark ..... 160/229 R

*Primary Examiner*—Richard E. Moore

*Attorney, Agent, or Firm*—Daryl W. Schnurr

[57] ABSTRACT

This invention relates to a locking device, having a U-shaped cross-section, for use with bi-fold doors. The device is designed to be slidably mounted on the top edge of one panel of a bi-fold door in the open position. When the door is closed, the device is slid over the top edge of both panels, and a bolt portion is inserted in the space between the two panels. To open the door, the locking portion is simply removed from said space and the locking device is moved to the top edge of just one of the panels.

4 Claims, 6 Drawing Figures

LOCKING DEVICE

BACKGROUND OF THE INVENTION

1. Field of the Invention

This invention relates to a locking device for use with folding closures.

2. Description of the Prior Art

Folding closures, usually of the bi-fold type, are commonly used in buildings. Bi-fold closures, of the louver or plain type, are often used as interior doors to separate rooms or as closet or cupboard doors. Bi-fold closures are often used as shutters located either outside or inside a window. Folding closures without a locking device are easy to open and are one of the first type of doors that small children learn to open. It is often desirable to prevent small children from entering certain rooms of a building or from entering closets. Also, where a folding closure is used to cover an exterior opening, it is desirable to have a locking device on the closure for security reasons.

It is known to have locking devices on folding closures. One such device is described in U.S. Pat. No. 2,715,040.

Unfortunately, previous devices suffer from various disadvantages in that they are not child-proof, they are too expensive to manufacture, they deteriorate the appearance of the folding closure with which they are used, they are cumbersome when the folding closure is in the open position or they are not portable from one folding closure to another.

SUMMARY OF THE INVENTION

The present invention relates to a locking device for use with a folding closure having two panels hinged together at their inner edges with a space between them. The locking device comprises a channel with a releasable locking means mounted thereon. The locking means has a bolt portion and the channel is designed to be slidably mounted over a top edge of one panel of the closure when the closure is in an open position. When the closure is in a closed position, the channel is designed to be slid over the top edges of both panels so that the bolt portion of the locking means can be inserted into the space between the inner edges, thereby preventing the locking device from sliding relative to the top edges of the two panels until the locking means is released.

Throughout this application, the folding closure is described as having two panels. It will be readily apparent to those skilled in the art that the locking device can easily be used with folding closures having more than two panels. It will simply be necessary to use one additional locking device for each panel beyond two in order to lock the closure.

BRIEF DESCRIPTION OF THE DRAWINGS

The device is further described in the accompanying drawings.

DESCRIPTION OF A PREFERRED EMBODIMENT

Figure 3:
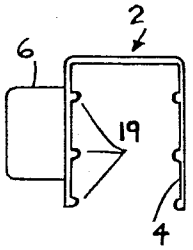
FIG. 3 is a sectional view of the device along the lines 1—1 of FIG. 1.
Figure 1:
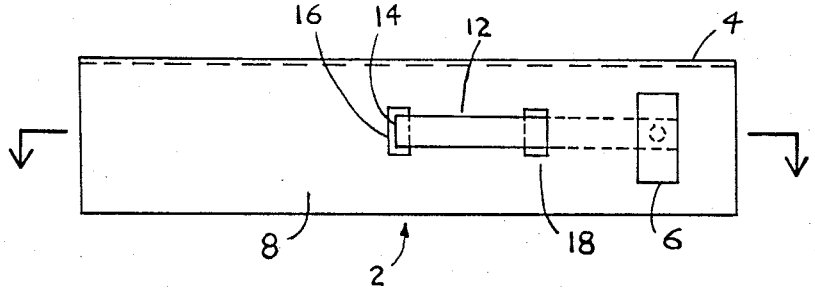
FIG. 1 is a front view of the locking device.
Figure 2:
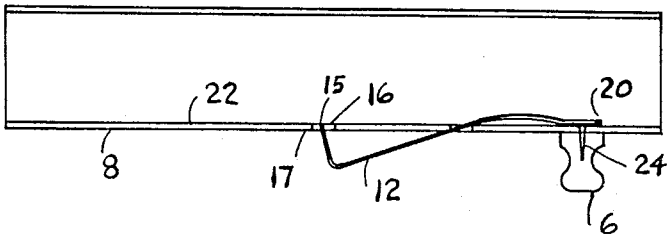
FIG. 2 is an end view of the locking device.

Referring to FIGS. 1, 2 and 3 in greater detail, there is shown a locking device 2 having a channel 4 with an inverted U-shaped cross-section. A handle 6 is mounted on a side portion 8 of the device 2. The locking means is strip 12 of a suitable metal. One end of the strip 12 is bent to form a bolt portion 14. The strip 12 is mounted so that the bolt portion 14 is adjacent to a suitable opening 16. The strip 12 extends within the channel 4 through a second opening 18. An end 20 of the strip 12 opposite to the bolt portion 14 is mounted on an inner surface 22 of the side portion 8 containing the openings 16, 18. The end 20 of the strip 12 is mounted by means of a screw 24, the same screw protruding from the channel 4 into the handle 6 to fasten the handle 6 to the side portion 8.

For ease of illustration, in FIG. 2, the bolt portion 14 is not fully inserted into the opening 16. Because of the way that the strip 12 is mounted, the natural stress in the metal forces the bolt portion 14 into the opening 16 whenever there is sufficient space within the channel 4 adjacent to the opening 16 of the bolt portion 14 to be inserted. Since there is nothing within the channel 4 as shown in FIG. 3 to obstruct the bolt portion 14, it would normally be fully inserted into the opening 16. It is only for ease of illustration that the bolt portion 14 is shown in the open position nearly completely outside of the opening 16. Although not shown, when the strip 12 is manually pulled so that the bolt portion 14 is completely outside the opening 16, an end 15 of the bolt portion 14 will rest on the side portion 8 at point 17. Thus the bolt portion 14 will not scratch a door or closure as the device is moved along the top edge.

Referring to FIG. 3 in greater detail, there are shown longitudinal ribs 19 on the inner surface 22 of the side portion 8. The ribs 19 space the inner surface 22 a sufficient distance from a door upon which the device 2 is mounted, so that the strip 12 and the screw 24 will not scratch the door when the device slides relative to the door.

Figure 4:
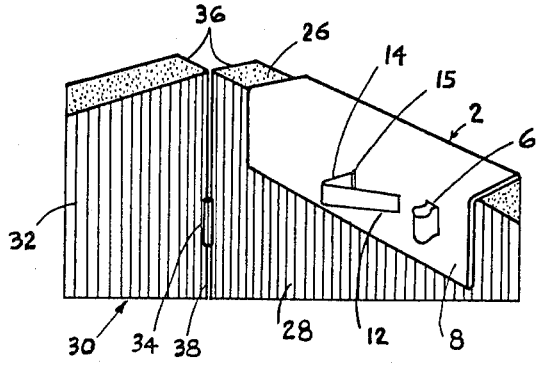
FIG. 4 is a partial perspective view of the device mounted on a top edge of a bi-fold closure in an open position.

Referring to FIG. 4 in greater detail, the locking device 2 is slidably mounted over a top edge 26 of one panel 28 of a bi-fold door or closure 30 (only partially shown). The door 30, which is only partially shown, is in an open position and the panel 28 is connected to a second panel 32 by hinges 34 (only one of which is shown). The two panels 28, 32 are hinged together at their inner edges 36 with a space 38 between them. The device 2 is mounted so that the top edge 26 of the panel 28 fits into the channel 4. The locking means or metal strip 12 has a bolt portion 14 which is designated to be inserted into the space 38 between the inner edges 36 when the door or closure 30 is in a closed position. The end 15 of the bolt portion 14 is resting on the side portion 8 at point 17 so that the bolt portion will not scratch the door 30 when the device 2 slides relative to the door.

Figure 5:
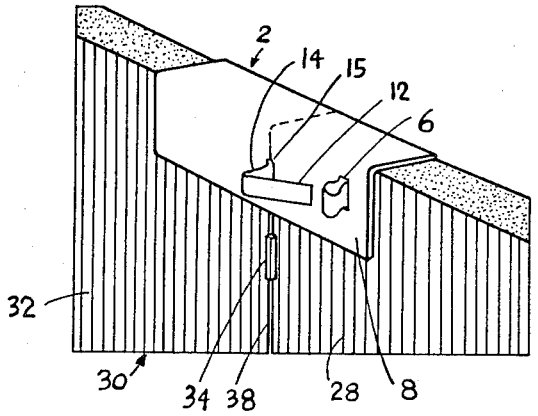
FIG. 5 is a partial perspective view of the device mounted over top edges of both panels of a bi-fold closure just before a bolt portion becomes inserted in a space between the two panels.

Referring to FIG. 5 is greater detail, when the bi-fold door is closed, the locking device 2 can be manually slid from the position shown in FIG. 4 over the top edges of both panels by means of the handle 6. In FIG. 5, the bolt portion 14 of the strip 12 has not yet become inserted within the opening 16 or the space 38. In order to insert the bolt portion 14 into the opening 16, the end 15 must be manually moved.

Figure 6:
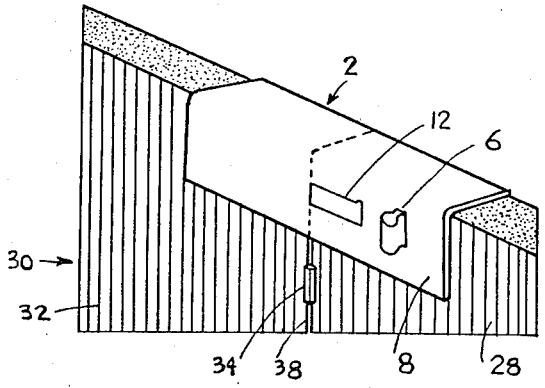
FIG. 6 is a partial perspective view of the device mounted on a folding closure in the closed and locked position.

In FIG. 6, the bolt portion 14 has become inserted in the opening 16 and into the space 34 between the inner edges 36 of the two panels 28, 32. To open the locking device 2, the metal strip 12 can be pulled outward so that the bolt portion leaves the space 38 and the opening 6 and the end 15 rests on the side portion 8 at the point 17. Then, the locking device 2 can be slid horizontally along the top edges of both panels to the top edge of only one panel. Once the locking device has been moved so that the bolt portion is no longer opposite to the space that part of the panel behind the opening 16 will prevent the bolt portion 14 from extending into the opening 16. Once the locking device 2 is on the top edge of only one panel 28, as shown in FIG. 4, the bi-fold door can then be opened.

As long as the door is tall enough to be well beyond the reach of small children, the locking device will be child-proof. In many installations, the door is greater than six feet from the floor and cannot be reached by a small child even if the child is standing on a chair.

What I claim as my invention is:

1. A locking device comprising a channel having a U-shaped cross section with a top portion and two side portions, with releasable locking means mounted on one of said side portions, said locking means being made of a strip of suitable metal and having two ends, one end of said strip being bent to form a bolt portion adjacent to an opening on said side portion, the other end of said strip extending within said channel through a second opening in said side portion with an end of the strip opposite to the bolt portion being mounted on an inner surface of said portion containing the openings, the strip being mounted under stress to force the bolt portion towards the opening to which it is adjacent.

2. A locking device as claimed in claim 1 wherein the bolt portion will rest on an outer surface of the side portion after it has been manually pulled completely from the opening.

3. A locking device as claimed in claim 1 wherein there are longitudinal ribs on said inner surface of said side portion to space said inner surface a sufficient distance from a closure upon which the device can be mounted so that the locking means does not scratch the closure when the device slides relative to a door.

4. A locking device as claimed in claims 1 and 2 wherein a handle is mounted outside of the channel using the same fastening means as that used to mount the strip.

* * * * *